US006494294B1

(12) United States Patent
Kubota et al.

(10) Patent No.: US 6,494,294 B1
(45) Date of Patent: Dec. 17, 2002

(54) LUBRICATING OIL SUPPLYING DEVICE

(75) Inventors: Kenichi Kubota, Morioka (JP); Norio Takehana, Shizukuishi-machi (JP); Takehiko Naiki, Takizawa-mura (JP)

(73) Assignee: Mikuni Adec Corporation (JP)

( * ) Notice: Subject to any disclaimer, the term of this patent is extended or adjusted under 35 U.S.C. 154(b) by 22 days.

(21) Appl. No.: 09/703,613

(22) Filed: Nov. 2, 2000

(30) Foreign Application Priority Data

Jan. 12, 2000 (JP) ..... 2000-003352

(51) Int. Cl.[7] ..... F16N 25/02

(52) U.S. Cl. ..... 184/34; 184/104.2; 137/625.48; 417/440

(58) Field of Search ..... 184/6.3, 6.22, 184/34, 81, 104.1, 104.2; 137/625.48, 878, 881, 563; 417/440, 441, 505; 239/124, 127

(56) References Cited

U.S. PATENT DOCUMENTS

| | | | |
|---|---|---|---|
| 3,777,482 A | 12/1973 | Canale et al. | 60/60.39 |
| 4,274,254 A | 6/1981 | Jansen et al. | 60/39.03 |
| 4,276,960 A | 7/1981 | Webb et al. | 184/6.22 |
| 4,327,772 A | 5/1982 | Kawabata | 137/625.48 |
| 4,541,394 A | 9/1985 | Schechter et al. | 123/506 |
| 5,385,455 A | 1/1995 | Dinsmore et al. | 417/505 |

FOREIGN PATENT DOCUMENTS

| | | | |
|---|---|---|---|
| JP | 2-245410 | 1/1990 | F01M/1/02 |
| JP | 7-32889 | 7/1995 | |
| JP | 7-65489 | 7/1995 | |

*Primary Examiner*—David A. Bucci
*Assistant Examiner*—Timothy McAnulty
(74) *Attorney, Agent, or Firm*—Lorusso & Loud

(57) ABSTRACT

A lubricating oil supplying device allows for the oil discharge amount to be more finely controlled by provision of many outlet ports, and by reducing the influence of vibration. Therefore, a spool valve unit and a pump are separately formed. The spool valve unit includes an open-close spool valve and a solenoid for controlling operation of this spool valve. Plural inlet passages and an outlet passage are formed in the spool valve. The spool valve opens or closes the inlet passages, and oil from the pump is introduced into these inlet passages. One side of the outlet passage communicates with the inlet passages, and the other side communicates with an engine. A passage for introducing the oil from an oil tank to a pump chamber is formed in the solenoid. When the solenoid is turned "OFF", communication between the return passage and the inlet passages is interrupted by the spool valve, and the oil is discharged from the pump to the plural inlet passages. The oil is discharged from the inlet passages to the engine via a check valve. When the solenoid is turned "ON", the return passage communicates with the inlet passages through the spool valve, and the oil is returned to the pump via the return passage.

12 Claims, 5 Drawing Sheets

LUBRICATING OIL SUPPLYING DEVICE

BACKGROUND OF THE INVENTION

1. Field of the Invention

This invention relates to a lubricating oil supplying device for supplying a lubricating oil to a 2-cycle engine, etc.

2. Description of the Background Art

An oil pump is conventionally used as a device for supplying lubricating oil to a 2-cycle engine. In the conventional oil pump, a plunger, formed with a pump chamber therein, is arranged within a cylinder such that the plunger can be freely rotated and reciprocated. An inlet port and an outlet port communicate with the pump chamber formed by the plunger in the cylinder. A wheel is formed on an outer circumferential surface of the plunger. The plunger is rotated by engaging this wheel with a driving worm operated by the engine. Thus, the pump chamber of the plunger is intermittently communicated with the inlet port and the outlet port formed in the cylinder. A cam is arranged at one end of the plunger and is biased by a spring so as to come in contact with a cam shaft. The stroke length of axial movement of the plunger is adjusted by rotation of the cam shaft.

In the above-described oil pump, pump action is achieved by changing the volume of the pump chamber formed in the plunger by the rotating and reciprocating movements of the plunger. Thus, the oil is discharged from the outlet port via the inlet port and the pump chamber, and is supplied to the engine.

The amount of discharge of the oil is related to the stroke length of the reciprocating movement of the plunger. This stroke length of the plunger is controlled by the shape of the cam shaft. The cam shaft coming in contact with the cam of the plunger is conventionally designed so that the amount of oil discharge is changed in accordance with the degree of opening of the throttle valve of a carburetor.

However, in the conventional design for controlling the amount of oil discharge in accordance with the degree of opening of the throttle valve of the carburetor, the amount of oil required for a given operating situation cannot necessarily be supplied to the engine at any time. For example, Japanese published (Kokoku) Patent No. 7-65489 is proposed as a solution to this problem. In this prior art, two inlet ports and two outlet ports are arranged to communicate with the pump chamber, and a spool valve for adjusting the amount of oil discharge is operated by a solenoid and is arranged in a discharge passage connected with the outlet ports. Operation of the solenoid is controlled in accordance with the operating state of the engine so that an appropriate amount of oil is supplied to the engine.

An increase in the number of outlet ports of the oil pump is one approach to provision of more appropriate control of the amount of oil supply to the engine. However, this approach encounters a problem in that it is difficult to increase the number of outlet ports for communicating the pump chamber within the plunger and the outlet ports with each other as in the conventional structure.

Further, the conventional oil pumps encounter a problem in that they are positioned where they are severely vibrated, and the amount of oil discharge cannot be appropriately controlled due to this vibration.

Furthermore, the oil pumps used in snowmobiles encounter the problem that the oil viscosity, due to low ambient temperatures, is so high that a delay is encountered in establishing the appropriate amount of discharge after the oil pump is started.

SUMMARY OF THE INVENTION

In consideration of the above points, an object of the present invention is to provide a lubricating oil supply device in which the amount of oil discharge can be finely controlled by provision of many outlet ports, and the appropriate amount of oil discharge can be secured by reducing influences of vibration.

Another object of the present invention is to provide a lubricating oil supplying device for rapidly returning the oil discharge amount to an appropriate level after the lubricating oil supplying device is started in low temperatures.

To achieve the above objects, the present invention provides a lubricating oil supply device which comprises a pump for discharging oil introduced from an oil tank, and a spool valve unit including open-close valve means having a spool valve and a solenoid for controlling operation of the spool valve. The open-close valve means is provided with plural inlet passages for introducing the oil from said pump, and an outlet passage having one end in communication with the inlet passages and the other end in communication with an engine. A return passage serves to return the oil of the open-close valve means to the pump. A communication hole in the valve spool provides communication between the inlet passages and the return passage. When the solenoid is turned "OFF", the communication of the inlet passages and the return passage is interrupted by the valve spool, and the oil is discharged from the pump to the engine via the inlet and outlet passages. When the solenoid is turned "ON", the inlet passages are brought into communication with the return passage via the communication hole through the valve spool, and the oil discharged from the pump to the inlet passages is returned from the communication hole to the pump via the return passage.

Further, in the present invention, an introducing passage in communication with the oil tank at one end and in communication with the return passage at the other end is formed within the solenoid, and the oil from the oil tank passes through the introducing passage within said solenoid.

DESCRIPTION OF THE PREFERRED EMBODIMENTS

Figure 1:
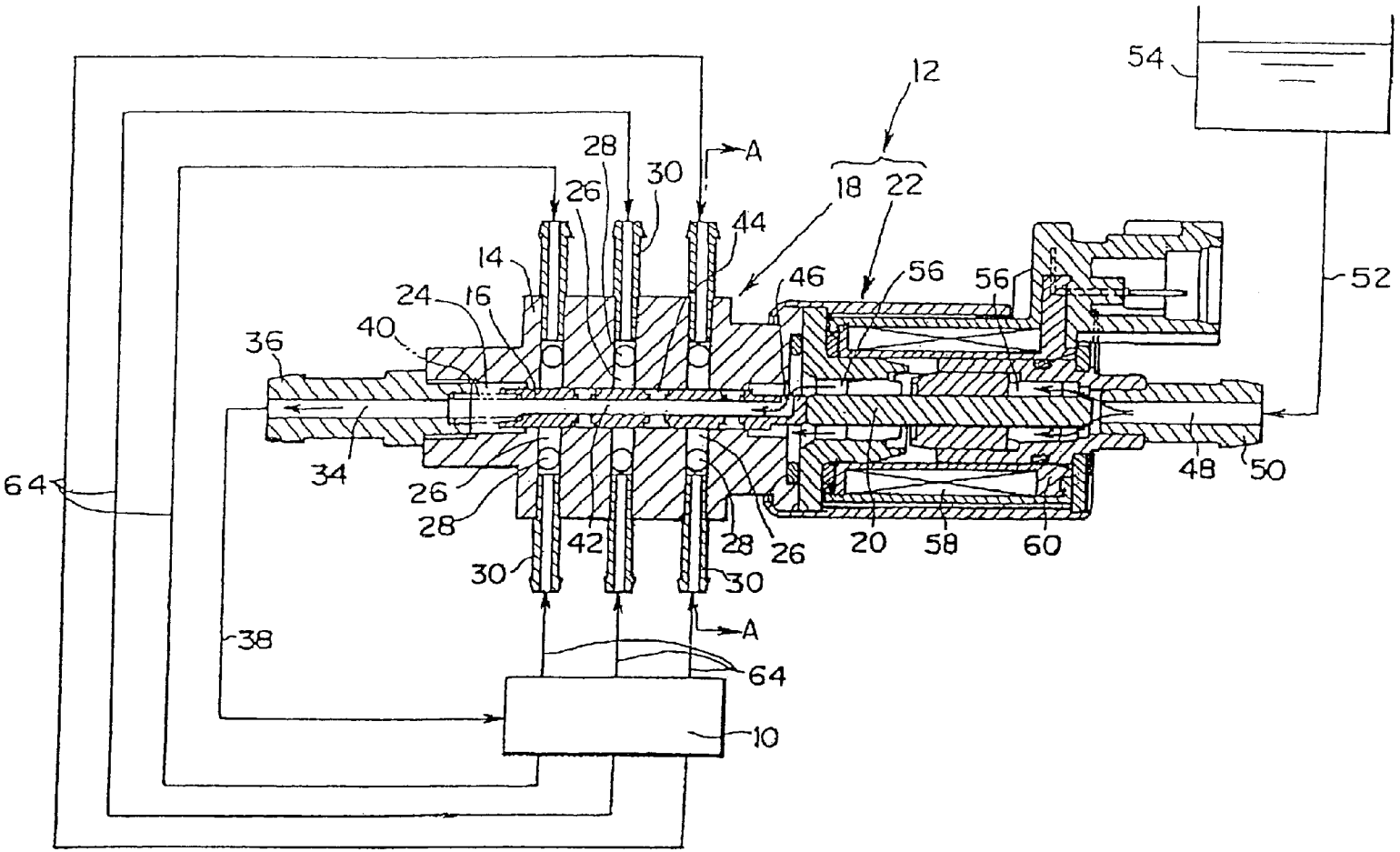
FIG. 1 is a view showing one embodiment of a lubricating oil supplying device of the present invention.

The present invention will next be explained with reference to the accompanying drawings.

The lubricating oil supplying device of the present invention includes a pump 10 and a spool valve unit 12 separated from pump 10. The pump 10 and the spool valve unit 12 can be arranged separate from each other. The spool valve unit 12 is preferably attached to the car body in a position where it is subject to only a low level of vibration. The pump 10 is desirably operated mechanically by an engine, but is not so limited. In the present invention, it is sufficient for the pump 10 to function for discharging oil. Therefore, description of the structure of this pump 10 is omitted here.

The spool valve unit 12 includes an open-close valve means 18 and a solenoid 22 having a movable iron core 20. The open-close valve means 18 has a spool 16 able to be reciprocated in an axial direction within a body 14. A central axis of the spool 16 and a central axis of the movable iron core 20 are axially aligned. An oil chamber 24 is formed within the body 14 of the open-close valve means 18. The spool 16 is arranged within this oil chamber 24 such that the spool 16 can be axially reciprocated. Plural inlet passages 26 (FIG. 1) and outlet passages 28 (FIG. 2) are formed in the body 14 of the open-close valve means 18. One side of each inlet passage 26 is in communication with the oil chamber 24, and the other side is open to the exterior. One side of each outlet passage 28 communicates with an intermediate portion of the inlet passage 26, and the other side is open to the exterior. An inlet pipe 30 (FIGS. 1 and 2) is attached to an opening of each inlet passage 26. An outlet pipe 32 (FIG. 2) is attached to an opening of each outlet passage 28.

A nipple 36 for return, forming a passage 34 in communication with the oil chamber 24, is attached to the body 14 of the open-close valve means 18. This nipple 36 for return and the pump 10 communicate with each other by a return passage 38. A spring 40 is arranged between the nipple 36 and the spool 16. The spool 16 is biased into contact with the movable iron core of the solenoid 22 by this spring 40.

Figure 3:
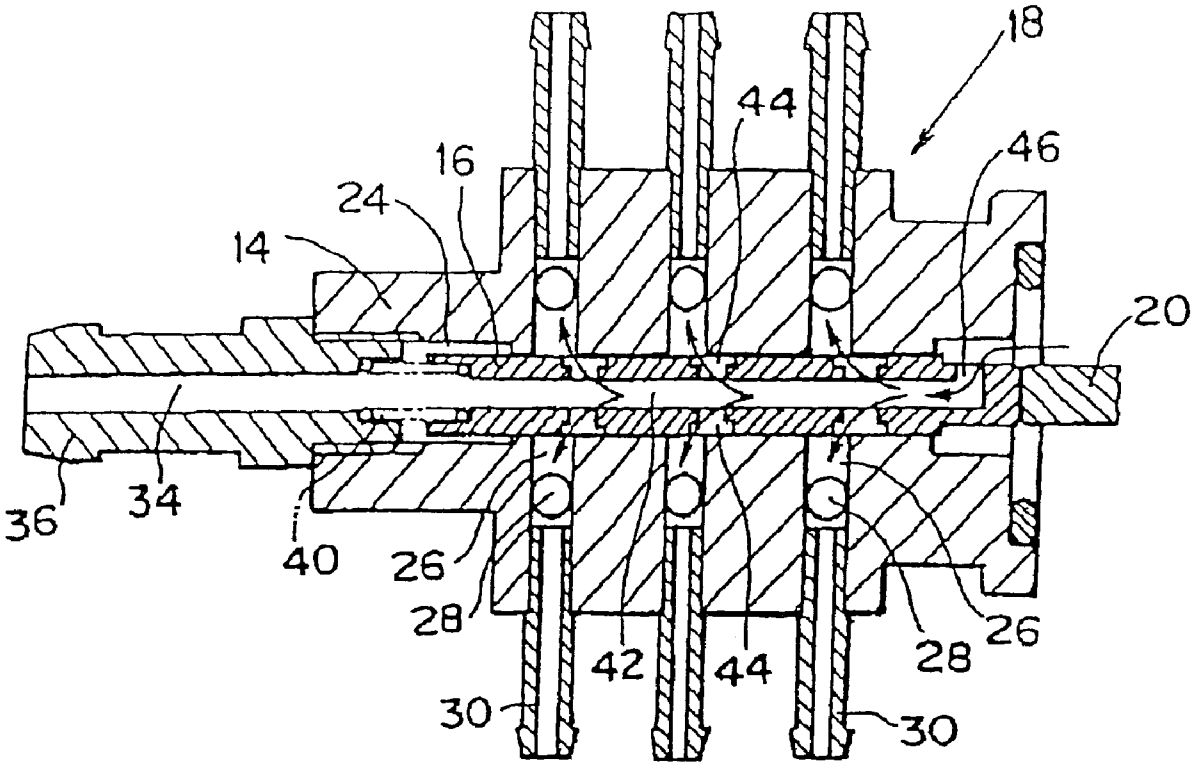
FIG. 3 is an enlarged sectional view of a main portion of the lubricating oil supplying device of FIG. 1 in with the solenoid turned "ON".

The movable iron core 20 is axially moved a predetermined distance by the turning on and off of an electric current to the solenoid 22. When the solenoid 22 is turned off, the movable iron core 20 is located in the position of FIG. 1 (moved rightward). In the position of FIG. 1, the spool valve 16 is biased by the spring 40 and is located in a position to the right in the drawing. When the solenoid 22 is turned on, the movable iron core 20 is moved leftward from the position of FIG. 1 to the position of FIG. 3, while pushing the spool 16 against the spring 40. In FIG. 3, the spool 16 is shown located in a position leftward of that shown in FIG. 1.

The spool 16 is formed as a sleeve with an interior space 42 serving as an oil passage. Plural communication holes 44 extend through the cylindrical wall of the spool 16. Further, an inlet hole 46 is formed in the spool 16 in a position closer to the movable iron core 20 than the communication holes 44. Since the spool 16 is arranged within the oil chamber 24, the space 42 becomes one portion of the oil chamber 24.

As shown in FIG. 1, communication holes 44 formed 15 in the spool 16 do not communicate with the inlet passage 26 when the solenoid 22 is "OFF". In this state, the outer wall of the spool 16 comes into contact with the body 14 to form an inner wall of the oil chamber 24, and communication between the oil chamber 24 and the inlet passage 26 is interrupted by the spool 16. In contrast, as shown in FIG. 3, when the solenoid 22 is "ON", each communication hole 44 formed in the spool 16 communicates with the inlet passage 26, and connects the space 42 (oil chamber 24) and the inlet passage 26 with each other.

An inlet nipple 50 defining a passage 48 therein is attached to the solenoid 22 opposite valve means 18. Oil is introduced from an oil tank 54 to this passage 48 via a passage 52. A passage 56 is formed along the exterior of the above movable iron core 20 within the solenoid 22. One end of the passage 56 is in communication with the passage 48 of the inlet nipple 50, and the other end is connected to inlet hole 46 of the spool 16. More specifically, in the solenoid 22, the passage 56 is formed in a hollow space of a bobbin 60 of a hollow sleeve shape having a coil 58 wound therearound. The oil from the oil tank 54 passes through the passage 56 within the solenoid 22. The oil passing through passage 56 is introduced through the inlet hole 46 of the spool 16 and into the space 42 within the spool 16.

Oil reaching the space 42 within the spool 16 is sucked into the inlet passage 26 from the communication hole 44 of the spool 16 when the solenoid 22 is turned "ON". The oil not entering the inlet passage 26 from the space 42 within the spool 16 is returned from the spool unit 12 (open-close valve means 18) to the pump 10 via the return passage 38.

Figure 2:
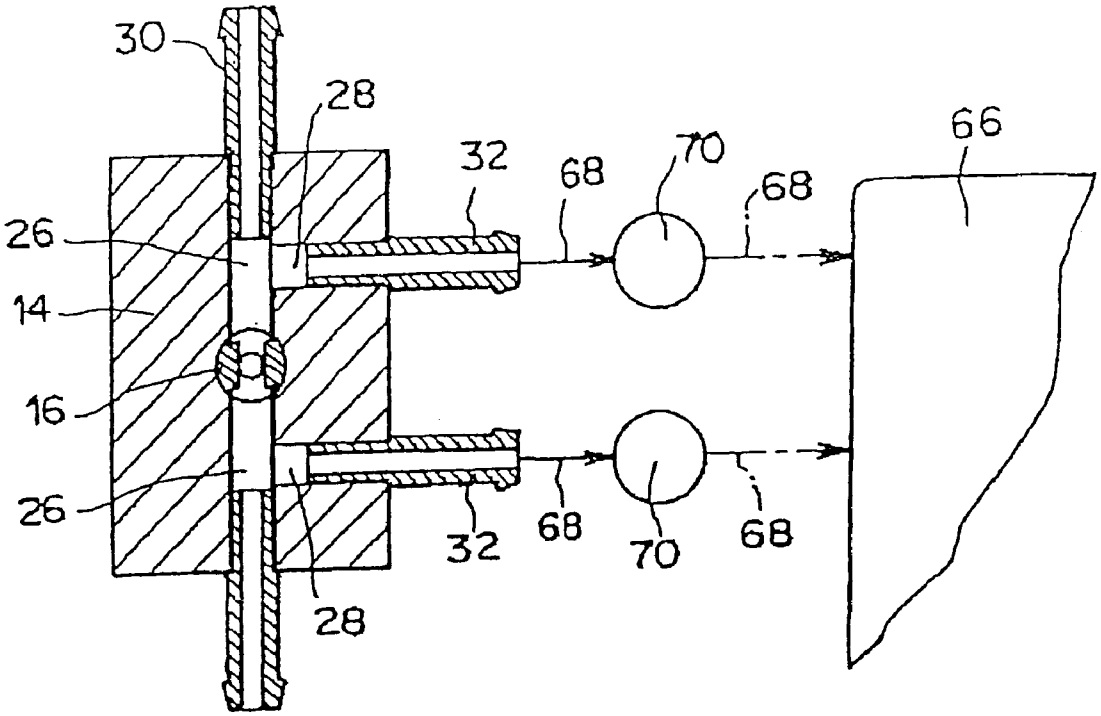
FIG. 2 is a cross-sectional view taken along line A—A in FIG. 1.

The pump 10 and each inlet pipe 30 communicate with each other through an outlet communicating passage 64. The oil is introduced from the pump 10 to the inlet passage 26 via the outlet communicating passage 64 and the inlet pipe 30. As shown in FIG. 2, the outlet passage 28 to the engine 66 is in communication with each inlet passage 26, and the oil is discharged from each outlet passage 28 to the engine 66 via an outlet communication passage 68. A check valve 70 is arranged in an intermediate portion of this outlet communication passage 68 and opens the outlet communication passage 68 only when the oil pressure is equal to or higher than a predetermined pressure.

The oil is supplied from the oil tank 54 to the spool valve unit 12 through the inlet communicating passage 52. The oil introduced to the spool valve unit 12 is introduced to the hollow space 42 of the spool 16 via the introducing passage 56 extending through the solenoid 22.

In the "OFF" state of the solenoid 22, the spool 16 is moved in the rightward direction as shown in FIG. 1, and interrupts the communication between the space 42 of the spool 16 and the inlet passage 26. In this state, the oil is discharged from the pump 10 to the inlet passage 26 via the outlet communication passage 64. Since communication of the inlet passage 26 with the space 42 of the spool 16 is interrupted by the spool 16, the oil supplied to each inlet passage 26 becomes elevated in pressure, flows through the outlet passage 28, and is discharged to the engine 66 by opening the check valve 70.

When the solenoid 22 is turned "ON", the spool 16 is moved from the state of FIG. 1 leftward so that the space 42 of the spool 16 and the inlet passage 26 communicate with each other through the communication hole 44 formed in the spool 16. Thus, the oil discharged from the pump 10 to the inlet passage 26 via the outlet communicating passage 64 reaches the space 42 of the spool 16 from the inlet passage 26 through the communication hole 44 of the spool 16. Thereafter , the oil is returned to the pump 10 via the return passage 38. The oil is guided from the inlet passage 26 to the outlet communicating passage 68 via the outlet passage 28, but the pressure of the oil reaching the outlet communicating passage 68 is low. Accordingly, no oil is discharged through the check valve 70 to the engine 66. Thus, the amount of oil supplied to the engine 66 can be controlled by suitably controlling the operation of the solenoid 22 in accordance with an operating parameter.

In the present invention, many inlet passages 26 for introducing the oil from the pump 10 are provided in the open-close valve means 18, and the spool 16, for opening and closing each of these many inlet passages 26 and the oil chamber 24 for escape of pressure from these inlet passages 26, is controlled by the solenoid 22. Thus, the amount of oil discharge can be finely controlled by provision of many inlet passages 26. Further, the pump 10 and the spool valve unit 12 can be mounted at positions separate from each other. Accordingly, the spool valve unit 12 can be attached at a position subjected to only a low level of vibration, and disturbance of the amount of oil discharge due to vibration can be prevented. Further, the oil is heated by passing the oil through the interior of the solenoid 22 so that the function of the spool valve unit can be rapidly established when the spool valve unit is started in a cold district.

Figure 4:
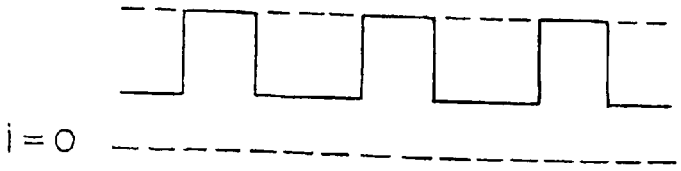
FIG. 4 is a view showing a pulse electric current flowing through the solenoid.

As shown in FIG. 4, a minimum pulse electric current supplied to the solenoid 22 is set to a nonzero ($i \neq +0$) electric current reduced to such an extent that solenoid 22 is not operated by this nonzero electric current. Thus, the oil passing through the solenoid 22 can be further heated.

Figure 5:
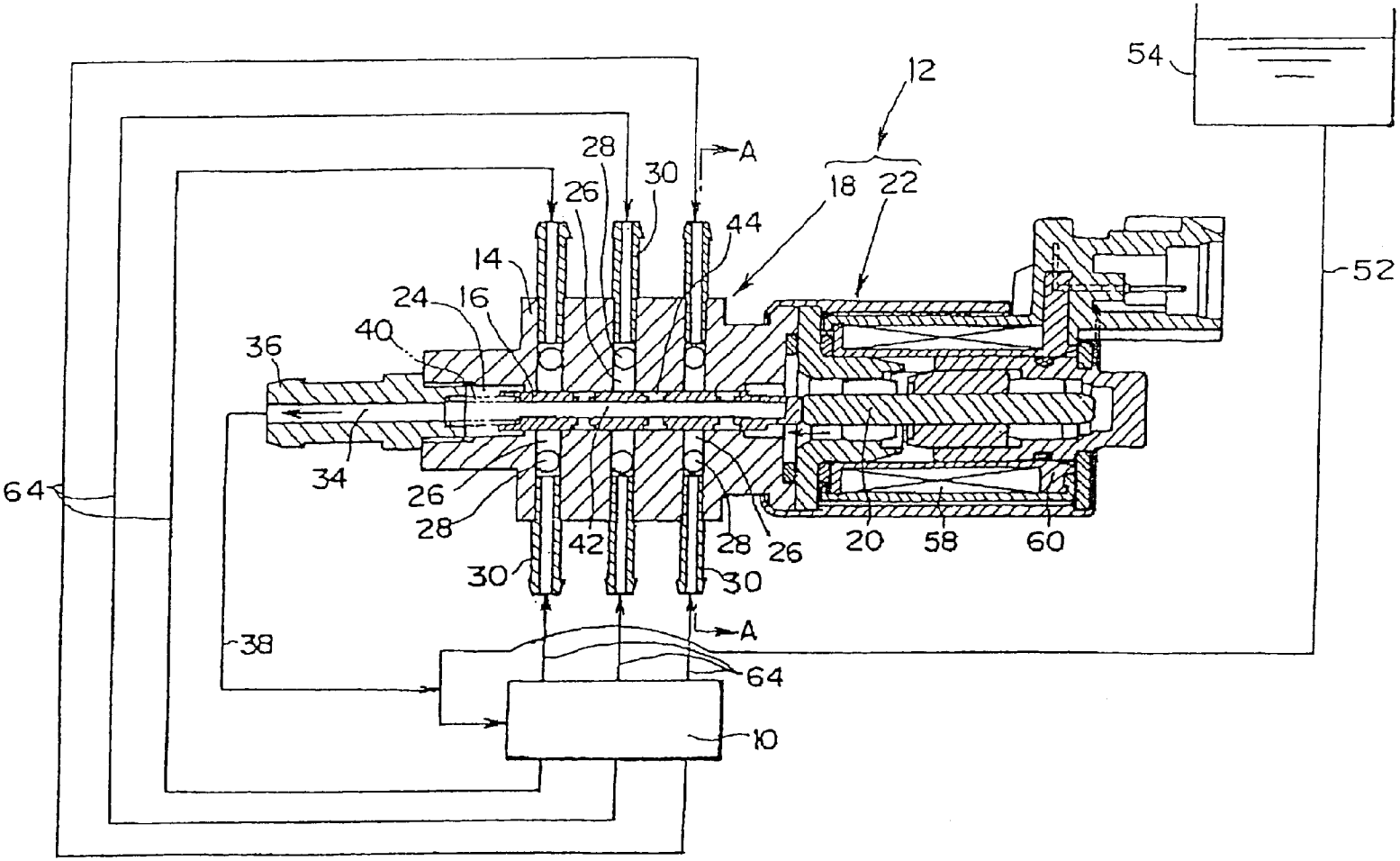
FIG. 5 is a view showing another embodiment of the lubricating oil supplying device of the present invention.

FIG. 1 shows a structure for passing the oil from the oil tank 54 through the interior of the solenoid 22. FIG. 5 shows an embodiment in which no oil from the oil tank 54 passes through the interior of the solenoid 22.

FIG. 5 mainly differs from FIG. 1 in that no inlet passage 52 for introducing the oil from the oil tank 54 communicates with the solenoid 22. Therefore, no oil passes through the interior of the solenoid 22, and the oil tank 54 communicates with the pump 10 through the inlet passage 52, and the oil from the oil tank 54 is introduced to the pump 10. Further, FIG. 5 differs from FIG. 1 in that the return passage 38 for returning the oil from the open-close valve means 18 to the pump 10 is in communication with an intermediate portion of the inlet passage 52. In FIG. 5, many inlet passages 26 can also be provided so that the amount of oil discharge can be more finely controlled.

As mentioned above, in accordance with the lubricating oil supplying device of the present invention, the amount of oil discharge can be finely controlled by provision of many inlet passages introducing the oil to the spool valve unit, so that the oil amount can be more finely controlled in comparison with the conventional device. Moreover, these many inlet passages can be opened and closed by one solenoid. Accordingly, it is not necessary to provide a solenoid for every outlet passage so that economic efficiency can be improved.

Further, in the present invention, since the pump and the spool valve unit can be arranged at locations separated from each other, it is possible to prevent the amount of oil discharge from being disturbed by vibration if mounted at a position of low level vibration.

In the present invention, since the oil is heated by 25 the solenoid by passing the oil through the interior of the solenoid, the function of the spool valve unit can be rapidly established after the spool valve unit is turned "ON", when the spool valve unit is used in a snowmobile used in a low temperature environment, etc. Moreover, if an electric current flows through the solenoid at any time, the oil is heated at that time so that the function of the spool valve unit can be more rapidly returned.

What is claimed is:

1. A lubricating oil supply device for supplying lubricating oil to an engine from an oil tank by a pump, said device comprising a spool valve and a solenoid for operating said valve, said spool valve comprising:

a valve body having an open longitudinal space, plural, spaced inlet passages extending radially from first ends opening into said longitudinal space and second ends connected to a discharge side of the pump, and at least one outlet passage having one end connected to at least one inlet passage and a second end connected to the engine for feeding the lubricating oil thereto;

a return passage for returning oil from said spool valve to the pump; and a spool member reciprocably mounted in said longitudinal space for reciprocating movement relative to the valve body between open and closed positions, under control of said solenoid, said spool member having communication passages respectively connecting said inlet passages with said return passage.

2. A lubricating oil supply device according to claim 1 wherein said solenoid has an oil introduction passage extending therethrough and connecting said return passage with the tank.

3. A lubricating oil supply device according to claim 1 wherein said spool member has an axially extending central passage connecting said communication passages with said return passage, said communication passages extending radially from said central passage to openings in an outer surface of the spool member which register with respective inlet passages, with the spool member in the open position, whereby oil discharged from the pump is returned to the pump via said return passage.

4. A lubricating oil supply device according to claim 1 wherein said spool valve is formed as a unit separate from the pump to allow the spool valve to be located at a location subject to minimal vibration.

5. A lubricating oil supply device according to claim 1 further comprising a check valve mounted within said one outlet passage for opening said outlet passage, responsive to oil pressure therein becoming equal to or higher than a predetermined pressure.

6. A lubricating oil supply device according to claim 2 wherein said spool member has an axially extending central passage connecting said communication passages with said return passage, said communication passages extending radially from said central passage to openings in an outer surface of the spool member which register with respective inlet passages, with the spool member in the open position, whereby oil discharged from the pump is returned to the pump via said return passage.

7. A lubricating oil supply device according to claim 2 wherein said spool valve is formed as a unit separate from the pump to allow the spool valve to be located at a location subject to minimal vibration.

8. A lubricating oil supply device according to claim 2 further comprising a check valve mounted within said one outlet passage for opening said outlet passage responsive to oil pressure therein becoming equal to or higher than a predetermined pressure.

9. A lubricating oil supply device according to claim 3 wherein said spool valve is formed as a unit separate from the pump to allow the spool valve to be located at a location subject to minimal vibration.

10. A lubricating oil supply device according to claim 3 further comprising a check valve mounted within said one outlet passage for opening said outlet passage responsive to oil pressure therein becoming equal to or higher than a predetermined pressure.

11. A lubricating oil supply device according to claim 4 further comprising a check valve mounted within said one outlet passage for opening said outlet passage responsive to oil pressure therein becoming equal to or higher than a predetermined pressure.

12. A lubricating oil supply device according to claim 1 wherein said outlet passages are identical in number to said plural inlet passages and wherein each of said outlet passages connects to an inlet passage.

* * * * *